US008720399B2

(12) United States Patent
Kato

(10) Patent No.: US 8,720,399 B2
(45) Date of Patent: May 13, 2014

(54) VALVE TIMING CONTROL APPARATUS OF INTERNAL COMBUSTION ENGINE

(75) Inventor: Hiroyuki Kato, Kanagawa (JP)

(73) Assignee: Hitachi Automotive Systems, Ltd., Ibaraki (JP)

( * ) Notice: Subject to any disclaimer, the term of this patent is extended or adjusted under 35 U.S.C. 154(b) by 246 days.

(21) Appl. No.: 13/418,381

(22) Filed: Mar. 13, 2012

(65) Prior Publication Data

US 2012/0318218 A1 Dec. 20, 2012

(30) Foreign Application Priority Data

Jun. 17, 2011 (JP) ..... 2011-134739

(51) Int. Cl.
*F01L 1/34* (2006.01)
*F01L 1/344* (2006.01)

(52) U.S. Cl.
CPC ..... *F01L 1/344* (2013.01)
USPC ..... 123/90.17

(58) Field of Classification Search
CPC ..... F01L 1/344; F01L 2001/34453; F01L 2001/34459; F01L 2001/34463; F01L 2001/34466; F01L 2001/34469; F01L 2001/34473; F01L 2001/34476
See application file for complete search history.

(56) References Cited

U.S. PATENT DOCUMENTS

| | | | | |
|---|---|---|---|---|
| 6,311,655 | B1 * | 11/2001 | Simpson et al. | 123/90.17 |
| 7,934,479 | B2 * | 5/2011 | Strauss | 123/90.17 |
| 8,516,981 | B2 * | 8/2013 | Jacques et al. | 123/90.17 |
| 2012/0017857 | A1 * | 1/2012 | Kato et al. | 123/90.15 |
| 2013/0092112 | A1 * | 4/2013 | Watanabe | 123/90.15 |

FOREIGN PATENT DOCUMENTS

JP 2010-195308 9/2010

* cited by examiner

*Primary Examiner* — Thomas Denion
*Assistant Examiner* — Daniel Bernstein
(74) *Attorney, Agent, or Firm* — Antonelli, Terry, Stout & Kraus, LLP.

(57) ABSTRACT

In a valve timing control apparatus of an internal combustion engine, a first lock member is installed axially movably on either one of a housing and a vane member, a first lock recess section with which the first lock member is engaged when the vane member is relatively revolved at an intermediate phase position between most advance and retardation angle sides is installed on the other of the housing and the vane member, and a third lock recess section is installed at a retardation angle side in a circumferential direction of the housing with respect to the first lock recess section to limit a relative rotary position of the vane member at the most retardation angle side by an engagement of the first lock member with the third lock recess section.

12 Claims, 7 Drawing Sheets

VALVE TIMING CONTROL APPARATUS OF INTERNAL COMBUSTION ENGINE

BACKGROUND OF THE INVENTION (1) Field of the Invention

The present invention relates to a valve timing control apparatus of an internal combustion engine which variably controls open-or-closure timing of at least one intake valve or at least one exhaust valve in accordance with a driving state.

(2) Description of Related Art

A previously proposed valve timing control apparatus of an internal combustion engine equipped in, so-called, a hybrid vehicle is described in a Japanese Patent Application First Publication No. (tokkai) 2010-195308 published on Sep. 9, 2010.

In this previously proposed valve timing control apparatus, an engine startability is improved by holding a valve timing of the intake valve(s) at an intermediate phase position between a most retardation angle position and a most advance angle position when a start of the engine in response to an operation of an ignition switch is carried out and a vibration of the engine at a time of the engine start is reduced by holding the valve timing at a more retardation angle side than the intermediate phase position when the engine is automatically started on a basis of a switching request of a traveling mode of the vehicle.

SUMMARY OF THE INVENTION

However, in the previously proposed valve timing control apparatus described in the above-described Japanese Patent Application First Publication, a lock pin and an intermediate lock hole are used to hold the valve timing of the intake valve at the intermediate position and a hydraulic pressure is utilized to hold the valve timing described above at the retardation angle position when the engine is automatically stopped. Hence, it is necessary to hold the valve timing at the retardation angle side by means of the hydraulic pressure even during the automatic stop of the engine and it is necessary to install an additional hydraulic pressure source of the hydraulic pressure to hold the valve timing at the retardation angle position.

It is, therefore, an object of the present invention to provide a valve timing control apparatus of an internal combustion engine which is capable of holding the valve timing at the retardation angle position not dependent upon the hydraulic pressure even in a case where the engine is automatically stopped.

According to one aspect of the present invention, there is provided with a valve timing control apparatus of an internal combustion engine, comprising: a housing to which a turning force is transmitted from a crankshaft of the engine and on an inside of which a working oil chamber is provided; a vane member fixed on a camshaft, the camshaft making at least one engine valve of the engine open or close, that partitions the working oil chamber into at least one advance angle hydraulic pressure chamber and at least one retardation angle hydraulic pressure chamber, and that relatively revolves toward an advance angle side to the housing and toward a retardation angle side to the housing by selectively supplying and exhausting a working oil to and from the advance angle hydraulic pressure chamber and the retardation angle hydraulic pressure chamber; a first lock member installed axially movably on either one of the housing and the vane member; a first lock recess section installed on the other of the housing and the vane member and with which the first lock member is engaged when the vane member is relatively revolved at an intermediate phase position between a most advance angle side and a most retardation angle side; a second lock member installed axially movably on either one of the housing and the vane member; a second recess section installed axially movably on the other of the housing and the vane member and with which the second lock recess section is engaged when the vane member is relatively revolved at the intermediate phase position; and a third lock recess section installed at the retardation angle side in a circumferential direction of the housing with respect to the first lock recess section to limit a relative rotary position of the vane member at the most retardation angle side by an engagement of the first lock member with the third lock recess section, the first lock recess section, in a state in which the first lock member is engaged with the first lock recess section, allowing a movement of the first lock member by a predetermined quantity toward the advance angle side and limiting the movement of the first lock member toward the retardation angle side of the first lock member and the second lock recess section, in a state in which the second lock member is engaged with the second lock recess section, allowing a movement of the second lock member by another predetermined quantity toward the retardation angle side and limiting the movement of the second lock member toward the advance angle side of the second lock member.

According to another aspect of the present invention, there is provided with a valve timing control apparatus of an internal combustion engine, comprising: a housing to which a turning force from a crankshaft is transmitted and on an inside of which a working oil chamber is provided; a vane member fixed on a camshaft, the camshaft making at least one intake valve of the engine open or close, that partitions the working oil chamber into at least one advance angle hydraulic pressure chamber and at least one retardation angle hydraulic pressure chamber, and that relatively revolves toward an advance angle side to the housing and toward a retardation angle side to the housing by selectively supplying and exhausting the working oil to and from the advance angle hydraulic pressure chamber and the retardation angle hydraulic pressure chamber; a first lock member installed axially movably on the vane member; a first lock recess section installed on the housing and with which the first lock member is engaged when the vane member is relatively revolved at an intermediate position between a most advance angle side and a most retardation angle side; and a third lock recess section installed at a retardation angle side of the housing in a circumferential direction of the housing with respect to the first lock recess section of the housing to limit a relative revolution position of the vane member at the most retardation angle side by an engagement of the third lock recess section with the first lock member, wherein the first lock recess section is so constructed that, in a state in which the first lock member is engaged with the first lock recess section, an inner surface of the first lock recess section at an advance angle side of the first lock recess section is in a non-contact state against an outer surface of the first lock member opposing against the inner surface of the first lock recess section and another outer surface of the first lock recess section at a retardation angle side of the first lock recess section and another outer surface of the first lock member opposing against the other inner surface of the first lock recess section are contacted on each other to limit a further movement of the first lock member toward the retardation angle side.

According to a still another aspect of the present invention, there is provided with a valve timing control apparatus of an internal combustion engine, comprising: a drive rotary body to which a turning force is transmitted from a crankshaft; a driven rotary body fixed on a camshaft, the camshaft making at least one intake valve open or close and that revolves a relative revolution angle to the drive rotary body in accordance with an operating state of the engine within a predetermined angle range; a phase modification mechanism equipped with at least one advance angle hydraulic pressure chamber and at least one retardation angle hydraulic pressure chamber and that relatively revolves the driven rotary body toward an advance angle side to the driven rotary body and a retardation angle side to the drive rotary body by selectively supplying and exhausting working oil to and from both of the advance and retardation angle hydraulic chambers; a first lock member installed axially movably on either one of the drive rotary body and the driven rotary body; a first lock recess section installed on the other of the drive rotary body and the driven rotary body to hold the driven rotary body at an intermediate phase position between a most advance angle side and a most retardation angle side by an engagement of the first lock member with the first lock recess section; a second lock member installed axially movably on either one of the drive rotary body and the driven rotary body; a second lock recess section installed on the other of the drive rotary body and the driven rotary body to hold the driven rotary body at the intermediate phase position when the second lock member is engaged with the second lock recess section; and a third lock recess section installed at a retardation angle side in a circumferential direction from the first lock recess section to limit a relative rotary position of the driven rotary body at a most retardation angle side by an engagement of the first lock member with the third lock recess section, the first lock recess section, in a state in which the first lock member is engaged with the first lock recess section, allowing a movement of the first lock member by a predetermined quantity toward the advance angle side and limiting the movement of the first lock member toward the retardation angle side and the second lock recess section, in a state in which the second lock member is engaged with the second lock recess section, allowing a movement of the second lock member by another predetermined quantity toward the retardation angle side and limiting the movement of the second lock member toward the advance angle side.

DETAILED DESCRIPTION OF THE INVENTION

Figure 1:
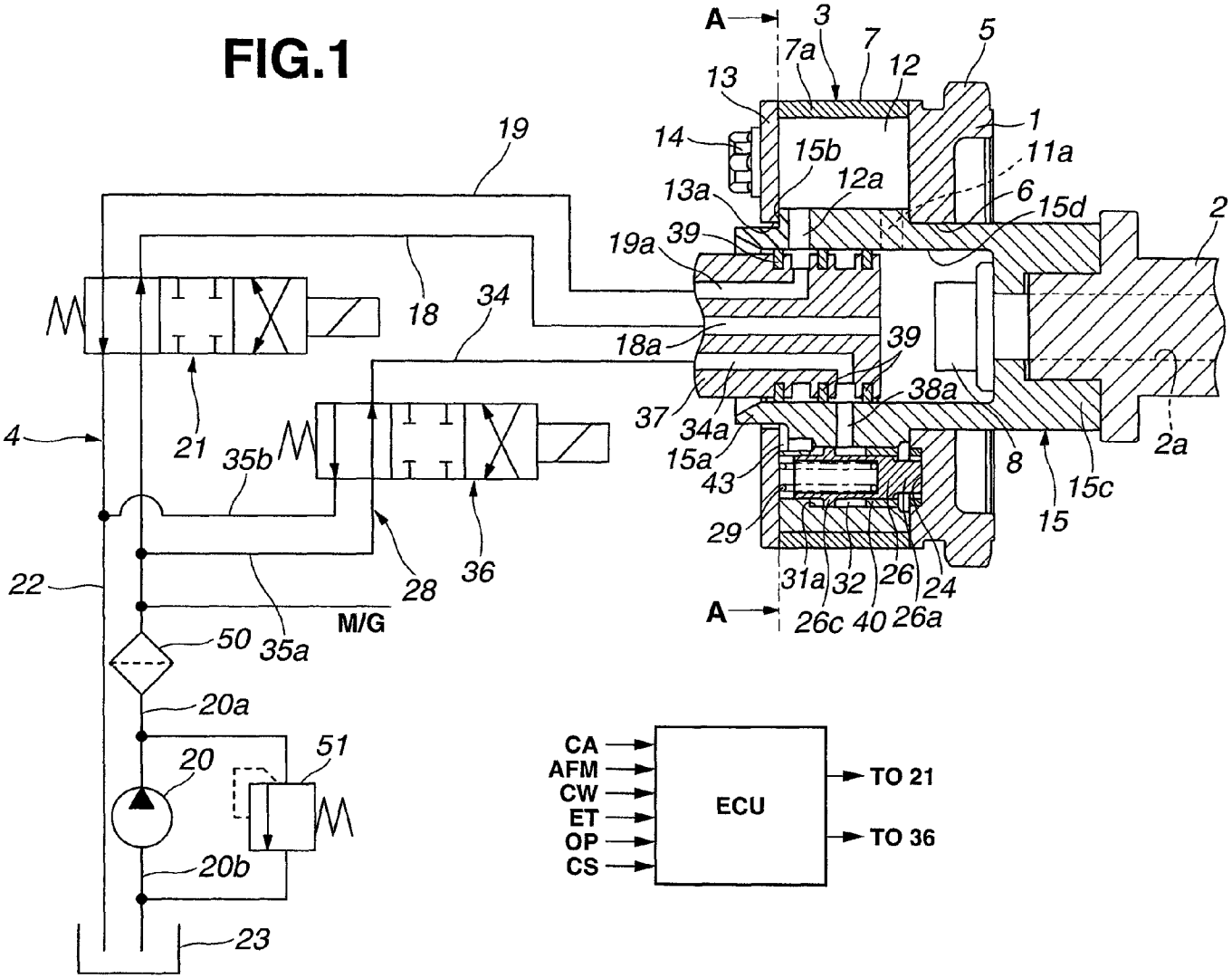
FIG. 1 is a whole configuration view representing a preferred embodiment of a valve timing control apparatus according to the present invention.

A preferred embodiment of a valve timing control apparatus of an internal combustion engine which is applicable to an intake valve side of, for example, a hybrid vehicle or an idle-stop vehicle will, hereinafter, be described with reference to the accompanied drawings.

The valve timing control apparatus according to the present invention, as shown in FIGS. 1 through 4, includes: a sprocket 1 which is a drive rotary body which is drivingly rotated via a timing chain through a crankshaft of the engine; an intake side camshaft 2 arranged along an engine forward-rearward (longitudinal) direction pivotably installed with respect to sprocket 1; a phase modification mechanism 3 interposed between sprocket 1 and camshaft 2 to convert a relative pivotal phase between sprocket 1 and camshaft 2; and a first hydraulic pressure circuit 4 to actuate phase modification mechanism 3.

Sprocket 1 is formed substantially in a thick disc shape and is provided with a gear section 5 on an outer periphery of which a timing chain is wound. Sprocket 1 is constituted by a rear cover closing a rear end opening of the housing as will be described later. A supporting hole 6 is penetrated at a center of sprocket 1. Supporting hole 6 is rotatably supported on an outer periphery of a vane member as will be described later fixed to camshaft 2.

Camshaft 2 is rotatably supported on a cylinder head (not shown) via a cam bearing. A plurality of cams which are operated in an open-and-closure manner for an intake valve (s) are integrally fixed at a predetermined position in the axial direction on an outer peripheral surface of camshaft 2 and a female screw hole 2*a* is formed in an inner axial center direction of camshaft 2 on one end section of camshaft 2.

Figure 2:
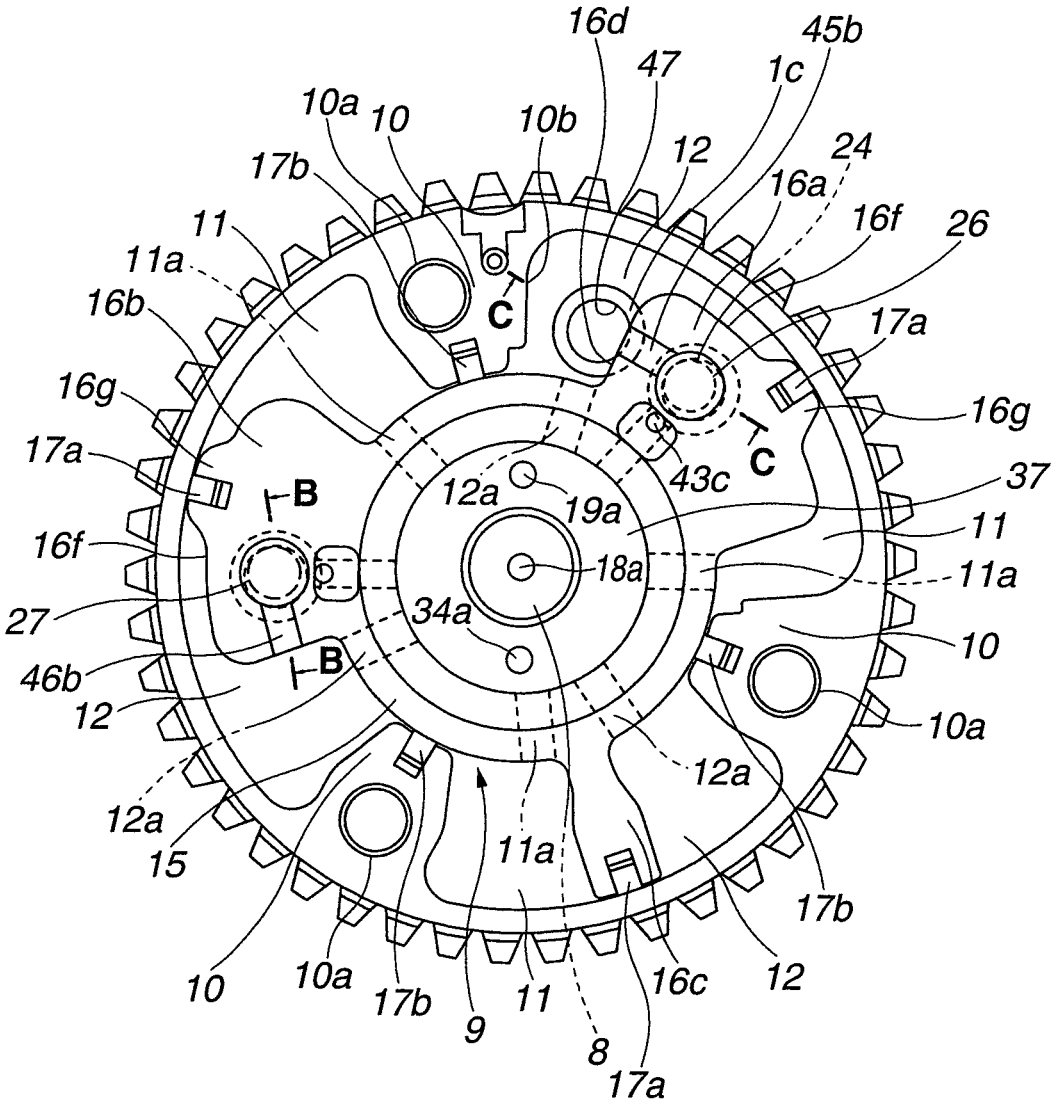
FIG. 2 is a cross sectional view of the valve timing control apparatus cut away along a line A-A in FIG. 1 representing a state in which a vane member used in the embodiment shown in FIG. 1 is held at a rotary position of an intermediate phase.

Phase modification mechanism 3, as shown in FIGS. 1 and 2, includes: a housing 7 coupled from the axial direction of sprocket 1 onto sprocket 1 and having a working oil chamber at an inside thereof; vane member 9 fixed via a cam bolt 8 screwed to female screw hole 2*a* located at one end section of camshaft 2 and which is a driven rotary body relatively rotatably housed within housing 7; and three retardation angle hydraulic pressure chambers 11 and three advance angle hydraulic pressure chambers 12 into which the working oil chamber is partitioned with three shoes 10 and vane member 9 provided on an inner peripheral surface of housing 7.

Housing 7 includes: a housing main frame 7*a* formed in a cylindrical shape and made of a sintered metal; a front cover 13 formed by a stamping to close a front end opening of housing main frame 7*a*; and sprocket 1 as a rear cover for a rear end opening of main frame 7*a*. Three bolts 14 penetrating through bolt inserting holes 10*a* of respective shoes 10 serve to fit altogether housing main frame 7*a*, front cover 13, and sprocket 1. An inserting hole 13*a* is penetrated at a center of front cover 13.

Vane member 9 is integrally formed by means of a metallic material. Vane member 9 includes: a vane rotor 15 fixed at one end section of camshaft 2 by means of a cam bolt 8; and a three first, second, and third vanes 16*a* through 16*c* projected radially from an outer peripheral surface of vane rotor 15 at a substantially 120° equal interval of position along a circumferential direction of vane member 9.

Vane rotor 15 is formed in a substantially cylindrical shape which is long with respect to a forward-and-rearward direction (longitudinal direction) of the vehicle (sprocket 1).

A seal member inserting guide section 15*a* in a thin cylindrical shape is integrally formed at a substantially center position of a front end surface 15*b* of vane rotor 15 and a rear end section 15*c* is extended in the direction off camshaft 2. In addition, a shaft shape fitting groove 15*d* is formed in an inside of a front end side of vane rotor 15.

Figure 3:
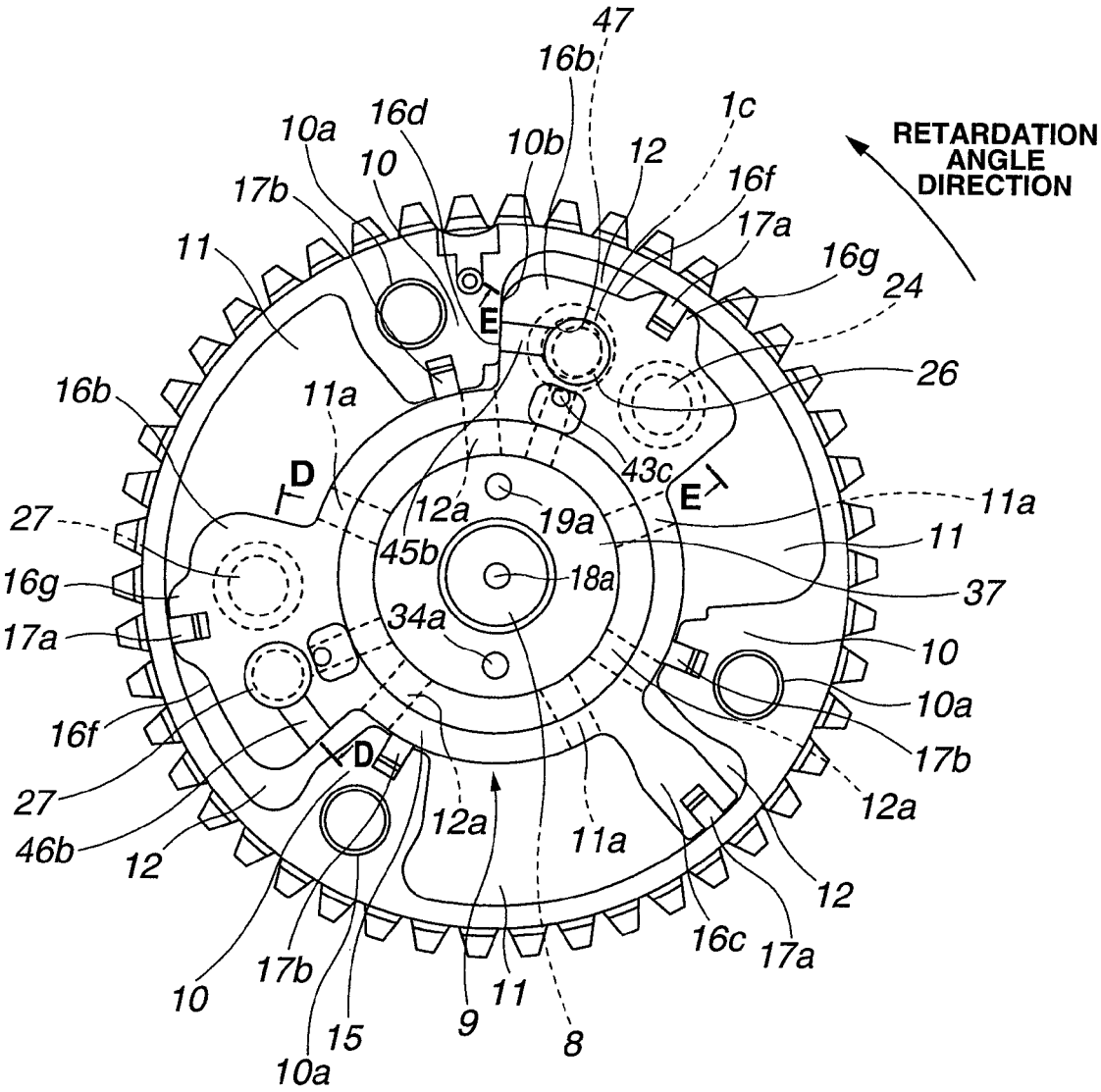
FIG. 3 is a cross sectional view of the valve timing control apparatus cut away along the line A-A in FIG. 1 representing a state in which the vane member used in the preferred embodiment is rotated at a position of a most retardation angle phase.
Figure 4:
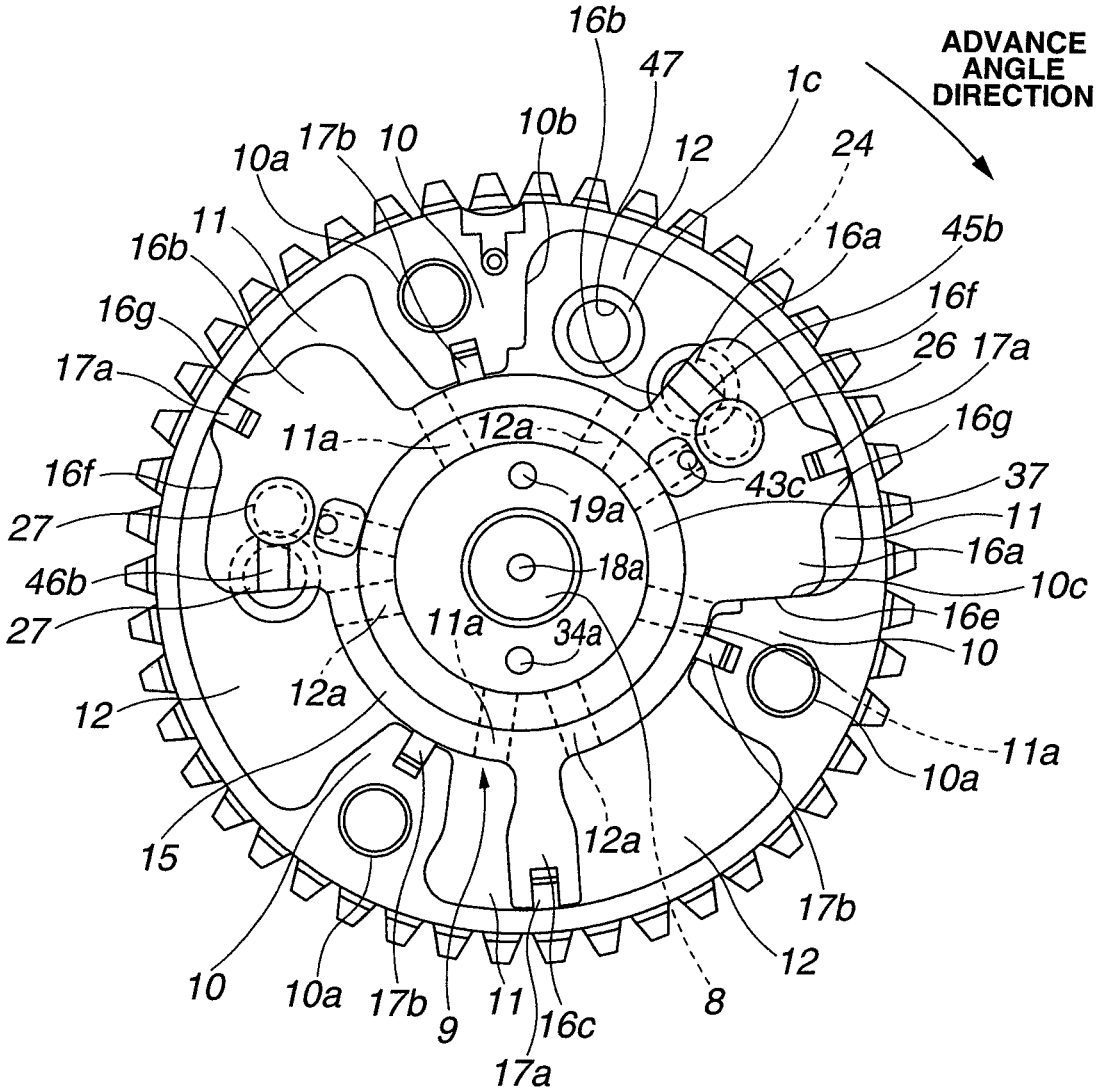
FIG. 4 is a cross sectional view cut away along the line A-A in FIG. 1 representing a state in which the vane member used in the preferred embodiment is rotated at a position of a most advance angle phase.

On the other hand, first, second, and third vanes 16*a*, 16*b*, 16*c* are disposed between respective shoes 10, as shown in FIGS. 2 through 4. A circumferential width of each vane 16*a*, 16*b*, 16*c* is mutually different. A first vane 16*a* of a maximum width and a second vane 16*b* of a middle width are formed in substantially sector shapes. A third vane 16*c* of a minimum width is formed in a thick elongated plate-like shape. A notch section 16*f* is formed on an outer peripheral surface of each of first and second vanes 16*a*, 16*b* to achieve a light weighting. A convex section 16*g* is formed on one side section in the circumferential direction of the notched outer peripheral surface. A seal member 17*a* is fitted into a seal groove formed between each convex section 16*g* and an outer peripheral surface of third vane 16*c* to seal each hydraulic pressure chambers 11, 12 while being slidably moved on an inner peripheral surface of housing main frame 7*a*. On the other hand, a seal member 17*b* is fitted into a seal groove formed on a tip inner peripheral section of each vane 16 (16*a*, 16*b*, 16*c*) in order to seal each hydraulic pressure chamber 11, 12 while slidably moved on the outer peripheral surface of vane rotor 15.

On the other hand, when vane member 9 is relatively rotated at the most retardation angle side, as shown in FIG. 3, the rotary position of vane member 9 at the maximum retardation angle side is limited by a contact of one side surface 16*d* of first vane 16*a* on a projecting surface 10*b* formed on an opposing side surface of a corresponding one of shoes 10. As shown in FIG. 4, when vane member 9 is relatively rotated at the most advance angle side, other side surface 16*e* of first vane 16*a* is contacted on projecting surface 10*c* of one of other shoes 10 on which other side surface 16*e* of first vane 16*a* is opposed so that the rotary position of vane member 9 at the maximum advance angle side is limited.

At this tome, other second and third vanes 16*b*, 16*c* are in a space-apart state in which both side surfaces of corresponding shoes 16*b*, 16*c* are not contacted on opposing surface of respective shoes 10. Hence, a contact accuracy between vane member 9 and shoe 10 is improved and a supply speed of the hydraulic pressure to each hydraulic pressure chamber 11, 12 as will be described later becomes faster so that a normal-reverse rotary responsive characteristic of vane member 9 becomes high.

Spaces between respective side surfaces in the normal and reverse rotational directions of first, second, and third vanes 16*a*, 16*b*, 16*c* and both side surfaces of respective shoes 10 are formed with retardation angle hydraulic pressure chambers 11 and advance angle hydraulic pressure chambers 12 as will be described later. Each retardation angle hydraulic pressure chamber 11 and advance angle hydraulic pressure chamber 12 are respectively communicated with first hydraulic pressure circuit 4 via first communication hole 11*a* and second communication hole 12*a* which are formed substantially radially at an inside of vane rotor 15.

First hydraulic pressure circuit 4 selectively supplies or exhausts a working oil (hydraulic pressure) with respect to each retardation angle and advance angle hydraulic pressure chambers 11, 12. As shown in FIG. 1, the hydraulic pressure is supplied or exhausted via a first communication passage 11*a* with respect to each retardation angle hydraulic pressure chamber 11 and via a second communication passage 12*a* with respect to each advance angle hydraulic pressure chamber 12. First hydraulic pressure circuit 4 further includes: an oil pump 20 which is a fluid pressure supply source which selectively supplies the working oil to each passage 18, 19; and a first electromagnetic switching valve 21 which switches a flow passage between retardation angle oil passage 18 and advance angle oil passage 19 in accordance with an operation state of the engine. This oil pump 20 is a generally available pump such as a trochoid pump which drivingly rotates by means of a crankshaft of the engine.

One end of each of retardation angle oil passage 18 and advance angle oil passage 19 is connected to a passage hole of first electromagnetic switching valve 21 and the other end thereof is communicated with a corresponding one of passage sections 18*a*, 19*a* formed in parallel to each other along an axial direction of a column shaped (columnar passage constituting section 37 within passage constituting section 37 inserted and held within an inside of vane rotor 15 of vane member 9 and within an inserting guide section 15*a* and is communicated with a corresponding one of each retardation angle hydraulic pressure chamber 11 and each advance angle hydraulic pressure chamber 12 via a corresponding one of first communication passage 11*a* and second communication passage 12*a*.

Passage constituting section 37 described above constitutes a non-rotary section whose outside end section is fixed to a chain cover (not shown) and a passage of a second hydraulic pressure circuit 28 which releases a lock of a lock mechanism as will be described later in addition to the other of respective passage sections 18*a*, 19*a* is formed in the axial direction of the inside of passage constituting section 37.

First electromagnetic switching valve 21, as shown in FIG. 1, is a proportional valve of a four-port and two-position type. A spool valve body (not shown) slidably installed in the axial direction of first electromagnetic switching valve 21 within a valve body thereof is moved in the forward-and-rearward direction of this valve 21 by means of an electronic controller ECU so that a discharge passage 20*a* of an oil pump 20 is communicated with either one of passages 18, 19. At the same time, a drain passage 22 is communicated with the other of both of oil passages 18, 19. In addition, during a stop of the engine, a spool valve body is held at an intermediate movement position in the axial direction so that all of the communications among oil passages 18, 19, discharge passage 20*a*, and drain passage 22 are interrupted to seal the working oil within respective retardation and advance angle hydraulic pressure chambers 11, 12.

A suction passage 20*b* of oil pump 20 and a drain passage 22 are communicated with each other within an oil pan 23. A filter 50 is disposed at a downstream side of discharge passage 20*a* of oil pump 20. A main oil gallery M/G which supplies a lubricating oil to a slide section of the internal combustion engine and so forth is communicated and connected to a downstream side of filter 50. Furthermore, a flow quantity control valve 51 which exhausts an excessive quantity of the working oil discharged from discharge passage 20*a* to oil pan 23 to control a flow quantity of the working oil to an appropriate flow quantity.

The above-described electronic controller includes a computer installed within the electronic controller and which inputs information signals from various kinds of sensors such as a crank angle sensor (an engine speed detection) CA, an airflow meter AFM, an engine cooling water temperature sensor CW, an engine temperature sensor ET, a throttle valve opening angle sensor OP, and a cam angle sensor CS which detects a present rotary phase of camshaft 2 so as to detect a present engine driving state and to perform a switching control for each passage by outputting a control pulse current to each electromagnetic coil of first electromagnetic switching valve 21 and a second electromagnetic switching valve 36 according to the detected present driving state of the engine as will be described later to control a movement position of respective spool valve bodies.

Then, in this embodiment, vane member 9 is held at a predetermined intermediate rotary phase position (a position shown in FIG. 2) by means of a first holding section of a position holding section between a rotary position of vane member 9 at the most retardation angle side (a position shown in FIG. 3) held by means of a second holding section of the position holding section and a rotary position at the most advance angle side (a position shown in FIG. 4).

The position holding section, as shown in FIGS. 2 through 6B, includes the first holding section to hold vane member 9 at the intermediate rotary phase position and the second holding section to hold vane member 9 at the rotary position of vane member 9 at the most retardation angle side. The first holding section mainly includes: annular two lock hole constituting members 1*a*, 1*b* installed at predetermined positions in the circumferential direction of sprocket 1 on an inner surface of sprocket 1; first and second lock holes 24, 25 which are lock recess sections formed on respective lock hole constituting members 1*a*, 1*b*; first and second lock pins 26, 27 which are two lock members respectively detachably engaged with respectively corresponding lock holes 24, 25; and second hydraulic pressure circuit 28 (refer to FIG. 1) which releases the engagements of respective lock pins 26, 27 with lock holes 24, 25.

Figure 5A:
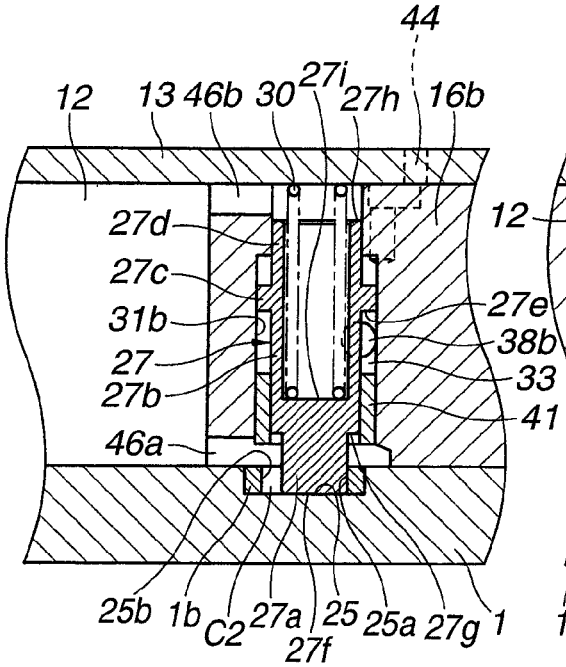
FIGS. 5A and 5B are a cross sectional view of the valve timing control apparatus cut away along a line B-B in FIG. 2 and a cross sectional view thereof cut away along a line C-C in FIG. 2, each representing an operation of a corresponding one of respective lock pins in the preferred embodiment.
Figure 5B:
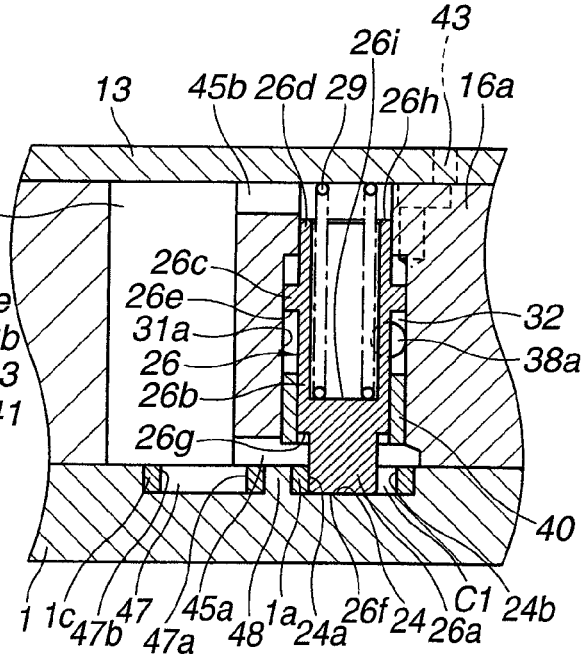
Figure 6A:
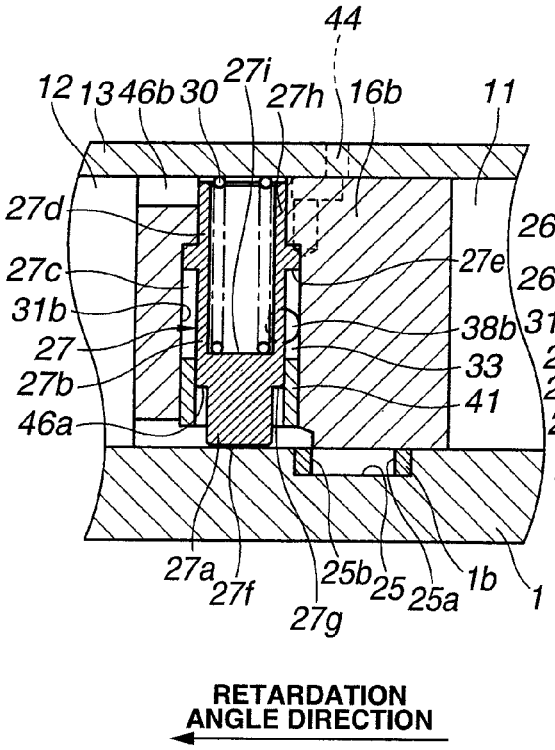
FIGS. 6A and 6B are a cross sectional view of the valve timing control apparatus cut away along a line D-D in FIG. 3 and a cross sectional view cut away along a line E-E in FIG. 3, each representing another operation of the corresponding one of the respective lock pins in the preferred embodiment.
Figure 6B:
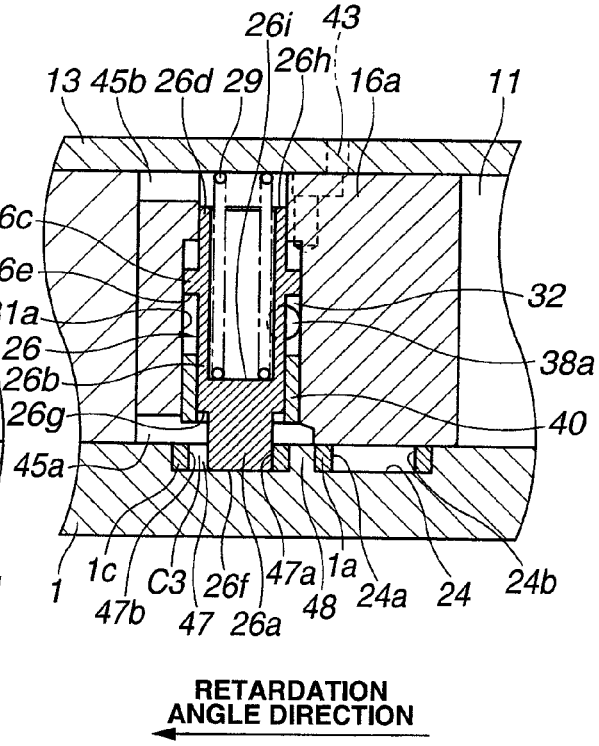

In addition, the second holding section to hold vane member 9 at the rotary position of the most retardation angle side includes: an annular third lock hole constituting member 1*c* installed at a left side in each of FIGS. 5B and 6B in the circumferential direction of first lock hole constituting member 1*a*; a third lock hole 47 which is a lock recess section formed on third lock hole constituting member 1*c*; first lock pin 26 detachably engaged with third lock hole 47; and second hydraulic pressure circuit 28. It should be noted that second hydraulic pressure circuit 28 constitutes one element of a detachably engaging section.

First lock hole 24 is, as shown in FIGS. 2 through 6B, formed in a circular shape along an inner peripheral surface of first lock hole constituting member 1*a* and is formed at the intermediate position on inner side surface 1*c* of sprocket 1 located at the intermediate position slightly near to the more advance angle side of vane member 9 than the rotary position of the most retardation angle side of vane member 9.

Second lock hole 25 is formed in a circular shape having the same inner diameter as first lock hole 24 along the inner peripheral surface of second lock constituting member 1*b* and is formed at the intermediate position on inner side surface 1*c* of sprocket 1 located slightly near to the more advance angle side of vane member 9 than the rotary position of the most retardation angle side of vane member 9.

Third lock hole 47 is formed in a circular shape having the same inner diameter as first lock hole 24 along the inner peripheral surface of third lock hole constituting member 1*c* and is formed at a position of the most retardation angle side which is located at a more leftward in FIGS. 5B and 6B than a formed position of first lock hole 24 via a partitioning wall section 48. Partitioning wall section 48 is formed between first lock constituting member 1*a* and third lock hole constituting member is and its width is relatively largely formed. This relatively large width is created according to an engagement state of first and second lock pins 26, 27 to first and second lock holes 24, 25.

First lock pin 26 has an outer peripheral surface formed in a cylindrical shape having a step difference form and is slidably disposed within a first pin hole 31*a* penetrated in an inner axial direction of first vane 16*a*. First lock pin 26 is integrally formed with: a tip section 26*a* having a smallest diameter; a middle diameter section 26*b* at a more rearward side than tip section 26*a*; and a first pressure receiving section 26*c* of a large diameter flange-like shape on an outer peripheral surface of a rear end side of middle diameter section 26*b*.

Tip section 26*a* of first lock pin 26 is formed in a substantially columnar shape having a relatively small diameter.

An outer diameter of tip section 26*a* is set to be smaller than an inner diameter of first lock hole 24.

In addition, tip section 26*a* has a tip surface 26*f* formed in a flat surface shape which is contactable in a tight attachment state for each bottom surface of first lock hole 24 and third lock hole 47.

A tip section (26*a*) side of middle diameter section 26*b* is liquid tightly slid on an inner peripheral surface of a sleeve 40 fixed under pressure at a tip side of first pin hole 31*a* and a rear end section 26*d* of first lock pin 26 is liquid tightly slid on a small diameter end of first pin hole 31*a*.

In addition, this first lock pin 26 is biased toward a direction in which first lock pin 26 is engaged with first lock hole 24 by means of a spring force of a first spring 29 which is a biasing member elastically interposed between a recess groove bottom surface formed in an inner axial direction of the recess groove from the rear end side of middle diameter section 26*b* and an inner surface of front cover 13.

In addition, the mutually same hydraulic pressures from advance angle hydraulic pressure chambers 12 are acted upon tip section 26*a* and rear end section 26*d* of this first lock pin 26 via front and rear oil holes 45*a*, 45*b* formed on first vane 16*a*.

That is to say, a pressure receiving area which is an addition of tip surface 26*f* of tip section 26*a* exposed to one of oil holes 45*a* and an annular tip surface 26*g* of middle diameter section 26*b* and another pressure receiving area which is an addition of a rear end surface 26*h* of rear end section 26*d* and a bottom surface 26*i* of a spring groove exposed to the other of oil holes 45*b* are set to mutually be the same and the mutually same hydraulic pressures as the advance angle hydraulic pressure chambers 12 are simultaneously acted upon these pressure receiving areas.

Furthermore, a lower end surface (refer to FIGS. 5B and 6B) of first pressure receiving section 26*c* is constituted as a first pressure receiving surface 26*e* exposed to a first release pressure receiving chamber 32 as will be described later and an upper end surface of first pressure receiving section 26*c* is opened to the air via a breathing hole 43 formed in a communication state within an inner part of first vane 16*a* and within front cover 13.

In addition, a movement of first lock pin 26 toward the retardation angle side is limited by a contact of one side edge of tip section 26*a* of first lock pin 26 on an opposing inner surface 24*a* of first lock hole 24 at the retardation angle side (third lock hole 47 side) of first lock hole 24 at a time point at which first lock pin 26 is engaged with first lock hole 24, as shown in FIG. 5B. On the other hand, the other side edge of tip section 26*a* of first lock hole 26 is engaged with an opposing inner side surface 24*b* at an advance angle side of first lock hole 24 via a predetermined gap C1 so that a slight movement of first lock pin 26 toward the advance angle direction is allowed via this predetermined gap C1.

Second lock pin 27 is slidably disposed within a second pin hole 31*b* penetrated in the inner axial direction of second vane 16*b* and has an outer diameter formed in a step difference diameter shape in the same way as first lock pin 26. Second lock pin 27 is integrally formed with: a tip section 27*a* having a minimum diameter; a middle diameter section 27*b* located at a more rearward side than tip section 27*a*; and a second pressure receiving section 27*c* in a large diameter flange shape on an outer peripheral surface of middle diameter section 27*b* at the rear end side of middle diameter section 27*b*.

Tip section 27*a* of second lock pin 27 is formed in a columnar shape. In addition, this tip section 27*a* has a tip surface 26*f* formed in a flat surface shape contactable on a bottom surface of second lock hole 25 in a tight attachment state.

A tip section (27*a*) side of middle diameter section 27*b* is liquid tightly slid on an inner peripheral surface of a sleeve 41 fixed under pressure at a tip side of second pin hole 31*b* and a rear end section 27*d* of second lock pin 27 is liquid tightly slid on a small diameter end section of second pin hole 31*b*.

In addition, this second lock pin 27 is biased toward a direction in which second lock pin 27 is engaged with second lock hole 25 by means of a spring force of a second spring 30 which is a biasing member elastically interposed between a recess groove bottom surface formed in an inner axial direction of the recess groove from the rear end side of middle diameter section 27*b* and an inner surface of front cover 13.

In addition, the mutually same hydraulic pressures from advance angle hydraulic pressure chambers 12 are acted upon tip section 27*a* and rear end section 27*d* of this second lock pin 27 via front and rear oil holes 46*a*, 46*b* formed on second vane 16*b*.

That is to say, a pressure receiving area which is an addition of tip surface 27*f* of tip section 27*a* exposed to one of oil holes 46*a* and an annular tip surface 27*g* of middle diameter section 27*b* and another pressure receiving area which is an addition of a rear end surface 27*h* of rear end section 27*d* and a bottom surface 27*i* of the spring groove exposed to the other of oil holes 46*b* are set to mutually be the same and the mutually same hydraulic pressures as the advance angle hydraulic pressure chambers 12 are simultaneously acted upon these pressure receiving areas.

Furthermore, a lower end surface (refer to FIGS. 5A and 6A) of second pressure receiving section 27*c* is constituted as a second pressure receiving surface 27*e* exposed to a second release pressure receiving chamber 33 as will be described later and an upper end surface of second pressure receiving section 27*c* is opened to the air via a breathing hole 44 formed across an inner part of second vane 16*b* and within front cover 13.

The movement of second lock pin 27 toward the advance angle side is limited by a contact of one side edge of tip section 27*a* of second lock pin 27 on an opposing inner surface 25*a* at the advance angle side of second lock hole 25 at a time point at which second lock pin 27 is engaged with second lock hole 25, as shown in FIGS. 5A and 5B. On the other hand, the other side edge of tip section 26*a* is engaged with an opposing inner side surface 25*b* at the retardation angle side of second lock hole 25 via a predetermined gap C2 so that a slight movement of second lock pin 27 toward the retardation angle direction is allowed via this predetermined gap C2.

As described hereinabove, by the simultaneous engagements of first and second lock pins 26, 27 to the corresponding first and second lock holes 24, 25, respectively, vane member 9 is held at an intermediate phase position between the most retardation angle phase and the most advance angle phase with respect to housing 7.

In a case where first lock pin 26 is engaged with third lock hole 47, as shown in FIGS. 6A and 6B, second lock pin 27 is slipped out of second lock hole 25 so that tip surface 27*f* of tip section 27*a* is elastically contacted on the inner surface of sprocket 1 by means of the spring force of second spring 30. In this state, one side edge of tip section 26*a* of first lock pin 26 is contacted on opposing inner side surface 47*a* at the advance angle side of third lock hole 47 so that the movement of first lock pin 26 toward the advance angle direction is limited. On the other hand, first lock pin 26 is slightly movable in the retardation angle direction with a predetermined gap C3 (refer to FIG. 7B) against inner side surface 47*b* of third hole 47.

Second hydraulic pressure circuit 28, as shown in FIGS. 1 and 5B, includes: a first releasing purpose pressure receiving chamber 32 formed between a large diameter step difference section of first pin hole 31*a* and a first pressure receiving section 26*c* of first lock pin 26; a second releasing purpose pressure receiving chamber 33 formed between the large diameter step difference section of second pin hole 31*b* and second pressure receiving section 27*b* of second lock pin 27; a supply-or-exhaust passage 34 which supplies the hydraulic pressure via a supply passage 35*a* branched from discharge passage 20*a* of oil pump 20 to first and second releasing purpose pressure receiving chambers 32, 33 and exhausts the working oil via an exhaust passage 35*b* branched from drain passage 22; and a second electromagnetic switching valve 36 (which is a second control valve) which selectively switches the supply-or-exhaust passage 34 and each passage 35*a*, 35*b* in accordance with the state of the engine.

First releasing-purpose pressure receiving chamber 32 and second releasing-purpose pressure receiving chamber 33 act the hydraulic pressures supplied to respective inner parts thereof on first and second pressure receiving surfaces 26*e*, 27*e* so that first and second lock pins 26, 27 are retreated from fist and second lock holes 24, 25 against the spring force of respective springs 29, 30 to release their respective engagements.

One end of supply-or-exhaust passage 34 is connected to a corresponding passage hole of second electromagnetic switching valve 36 and the branched other end side of supply-or-exhaust passage section 34*a* is bent in a diameter direction from the inner axial direction of passage constituting section 37. This supply-or-exhaust passage section 34*a* is branched and communicated with first and second oil passage holes 38*a*, 38*b* branched at vane rotor 15 to respective first and second releasing purpose pressure receiving chambers 32, 33 via first and second oil passage holes 38*a*, 38*b*.

Furthermore, passage constituting section 37 is formed with a plurality of annular fitting grooves at the forward-and-rearward position of the axial direction of the outer peripheral surface of the passage constituting section 37 and three annular seal members 39 to seal between opening ends formed between respective passage sections 18*a*, 19*a* and a supporting hole 15*d* side of first supply-or-exhaust passage section 34*a* are fixedly fitted into respective fitting grooves.

Second electromagnetic switching valve 36 is a proportional valve of four-port-and-three-position type. In second electromagnetic switching valve 36, in response to a control current of on-or-off outputted from electronic controller ECU and a spring force of a valve spring provided at an inside of switching valve 36, a spool valve body thereof causes an appropriate selective communication between supply-or-exhaust passage 34 and passages 35*a*, 35*b* and to interrupt the communication between supply-or-exhaust passage 34 and respective passages 35*a*, 35*b* to seal the working oil within respective releasing purpose pressure receiving chambers 32, 33.

Hereinafter, an action of the preferred embodiment described above will be described. [an operation control after a short-term stop] First, suppose a case where the engine is automatically stopped not according to an off operation of an ignition switch (namely, at a time of an idle stop).

In this supposition, at a time point immediately before the engine is completely at an automatic stop, vane member 9 allows a free reversible rotation thereof. At this time, the control current is outputted from electronic controller ECU to first electromagnetic switching valve 21 so that discharge passage 20*a* and retardation angle oil passage 18 are communicated with each other and drain passage 22 and advance angle oil passage 19 are communicated with each other. This causes each retardation angle hydraulic pressure chamber 11 to be in a high pressure state and each advance angle hydraulic pressure chamber 12 to be in a low pressure state. Therefore, vane member 9 is, as shown in FIG. 3, relatively rotated toward the retardation angle side so that first vane 16*a* is contacted on a projection surface 10*b* of one of shoes 10 placed at an opposite side of a rotational direction of vane member 9 and a more retardation angle direction rotation of vane member 9 is limited at a position of the most retardation angle side.

At this time, first lock pin 26 is moved straightly in the downward direction toward sprocket 1 by means of a spring force of spring 29, as shown in FIG. 6A, so that tip section 26*a* of first lock pin 26 is engaged with third lock hole 47. Thus, vane member 9 is held at a position of the most retardation angle side with respect to housing 7. On the other hand, second lock pin 27 is, as shown in FIG. 6A, slipped out of the position of second lock hole 25 so that the engagement of second lock pin 27 with second lock hole 25 is released. In addition, the spring force of second spring 30 causes tip section 27*a* of second lock pin 27 to be held at a retreat position (moved and stayed in the upward direction toward front cover 13) elastically contacted on the inner surface of sprocket 1.

This conversion state of the most retardation angle phase is confirmed by electronic controller ECU according to a detection signal from cam angle sensor CS and, thereafter, the engine is stopped.

Thereafter, in a case where the internal combustion engine starts automatically a cranking in a short time, at this time point, vane member 9 is held at the rotary phase position at the most retardation angle side shown in FIG. 3 with the engagement state of first lock pin 26 to third lock hole 47 continued. Hence, a closure timing of the intake valve is at the most retardation angle side than a bottom dead center (BDC) of a piston. Consequently, an effective compression ratio is reduced, a pumping loss is reduced, and a vibration at the time of engine start is sufficiently reduced so that a favorable startability of the engine can be obtained.

In addition, a tramp (or fluctuation) of vane member 9 due to a variation of an alternating torque can sufficiently be suppressed due to a maintenance of an engaged state of first lock pin 26 into third lock hole 4. Especially, since one side edge of first lock pin 26 is contacted on opposing inner side surface 47*a* of third lock hole 47 (refer to FIG. 6B), the fluctuation of vane member 9 toward the advance angle side can sufficiently be suppressed.

After this restart of the engine is initiated, electronic controller ECU supplies the control current to second electromagnetic switching valve 36 to communicate between supply passage 35*a* and supply-or-exhaust passage 34 so that the hydraulic pressure is supplied to each pressure receiving chamber 32, 33. Hence, although this hydraulic pressure causes second lock pin 27 to be maintained at a slipping out state (released state, disengagement state, or axial backward movement state in a broadest sense) from second lock hole 25, first lock pin 26 is retreated (moved axially toward a backward direction) to release the engagement of (disengage) first lock pin 26 with (or from) first lock hole 24.

Consequently, vane member 9 is allowed to be in a free rotation thereof and a relative rotation phase of vane member 9 by means of first hydraulic pressure circuit 4 in accordance with the engine driving state can arbitrarily be conversion controlled.

[Operation Control After a Lapse of Long Time]

In a case where the engine is stopped after the ignition switch is in an off operation after the vehicle travels, there is a high possibility that a cold state of the engine occurs at a time of the subsequent restart.

In a case where the ignition switch is turned off to stop the engine, the control current is outputted from electronic controller ECU to first electromagnetic switching valve 21. At this time, the spool valve body of electromagnetic switching valve 21 is moved in one direction of the axial direction so that discharge passage 20 is communicated with either one of retardation angle oil passage 18 or advance angle oil passage 19 and drain passage 22 is communicated with the other of retardation and advance angle oil passages 18, 19. In details, electronic controller ECU detects the present relative rotary position of vane member 9 on a basis of the information signal from cam angle sensor CS and crank angle sensor CA and first electromagnetic switching valve 21 is operated on the basis of the detected present relative rotary position of vane member 9 by means of electronic controller ECU to supply the hydraulic pressure to either respective retardation angle hydraulic pressure chambers 11 or respective advance angle hydraulic pressure chambers 12. Thus, vane member 9 is rotationally controlled up to the predetermined intermediate position between the most retardation angle side and the most advance angle side, as shown in FIG. 2.

At the same time, electronic controller ECU supplies an electric power to second electromagnetic switching valve 36 to communicate supply-or-exhaust passage 34 with exhaust passage 35*b*. Thus, the working oil within first and second releasing purpose pressure receiving chambers 32, 33 is exhausted to provide the low pressure state and each lock pin 26, 27 is biased toward an advance direction (a direction toward which each lock pin 26, 27 is engaged with the corresponding one of lock holes 24, 25) according to the spring force of each spring 29, 30, as shown in FIGS. 5A and 5B. so that each lock pin 26, 27 is engaged with the corresponding one of lock holes 24, 25.

In this state, as shown in FIGS. 5A and 5B, one side edge of tip section 26*a* of first lock pin 26 is contacted on opposing inner side surface 24*a* of first lock hole 24 at the retardation angle side so that the movement of vane member 9 in the retardation angle direction is limited. On the other hand, one side edge of tip section 27*a* of second lock pin 27 is contacted on opposing inner side surface 25*a* of second lock hole 25 at the advance angle side so that the movement of vane member 9 in the advance angle direction is limited. This operation causes vane member 9 to be held at the intermediate phase position, as shown in FIG. 2, and the valve closure timing of the intake valve(s) is controlled to the more advance angle side than the bottom dead center (BDC) of the piston of the engine.

Hence, in a case where a sufficient time is elapsed from a time at which the engine is stopped and the engine is restarted in a cold state of the engine, an effective compression ratio of the engine according to a characteristic closure timing of the intake valve is increased and a combustion of fuel of the engine becomes favorable. Consequently, a stabilization of the engine start and the improvement in the startability of the engine can be achieved.

In addition, when the engine driving state is transferred to an ordinary driving after the completion of the warm-up engine and enters, for example, a high revolution area, first electromagnetic switching valve 21 is operated to communicate discharge passage 20*a* with advance angle oil passage 19 and to communicate retardation angle hydraulic pressure chamber 18 with drain passage 22.

Thus, each retardation angle hydraulic pressure chamber 11 provides the low pressure and each advance angle hydraulic pressure chamber 12 provides the high pressure. Thus, vane member 9 is rotationally moved at the most advance angle side, as shown in FIG. 4. Consequently, an open timing of the intake valve(s) becomes earlier so that a valve overlap to an exhaust valve(s) becomes large, an intake air quantity is increased, and an output power of the engine is accordingly increased.

At this time point, as described hereinabove, second electromagnetic switching valve 36 communicates supply-or-exhaust passage 34 with supply passage 35*a* so that the hydraulic pressure is supplied to each pressure receiving chamber 32, 33 and a state in which exhaust passage 35*b* is closed is maintained. Hence, the free rotation of vane member 9 is secured.

As described hereinabove, in the preferred embodiment, the compression ratio of the engine at the time of the engine restart in accordance with a stop time of the engine, namely, in accordance with a temperature of the engine, is modified. Hence, the startability of the engine due to a reduction in a torque load at the time of restart by means of the ignition switch is improved. In addition, a reduction in vibrations at the time of the restart from the idle stop and an exhaust emission performance can be improved.

In addition, the position holding section serves to improve a holding ability of vane member 9 at the intermediate phase position and, in a state of a warmed-up state during the idle stop, first lock pin 26 is engaged with third lock hole 47 at the most retardation angle phase position of vane member 9. Hence, the holding ability of vane member 9 not dependent upon the hydraulic pressure at the most retardation angle phase position is improved.

Furthermore, as described hereinabove, in a holding state of vane member 9 at the intermediate phase, one side edge of tip section 26*a* of first lock pin 26 is contacted on opposing inner side surface 24*a* of first lock pin 26 at the retardation angle side of first lock hole 24 so that the movement of vane member 9 in the retardation angle direction is limited. On the other hand, one side edge of tip section 27*a* of second lock pin 27 is contacted on opposing inner side surface 25*a* at the advance angle side of second lock hole 25 so that the movement of vane member 9 toward the advance direction is limited. Thus, both of first and second lock pins 26, 27 are arranged in a mutually approaching direction. A wall thickness of partitioning wall section 48 can be increased as largely as possible.

Figure 7A:
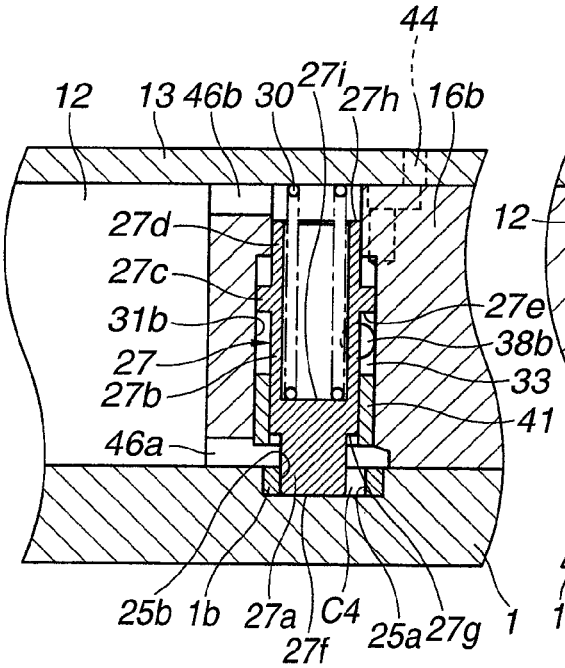
FIGS. 7A and 7B are a cross sectional view of a reference (or a comparative example) valve timing control apparatus cut away along line B-B in FIG. 2 and a cross sectional view cut away along line C-C in FIG. 2, each representing a state in which formed positions of first lock hole and second lock hole are different from the preferred embodiment shown in FIGS. 1 through 6B.
Figure 7B:
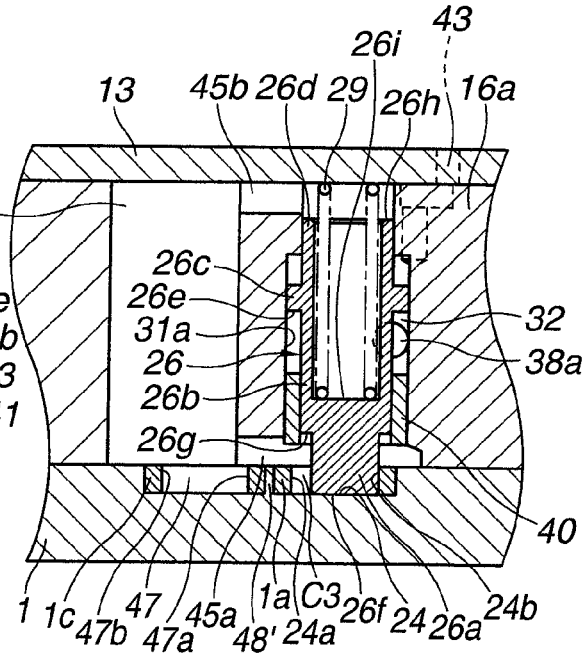

That is to say, the rotary position of vane member 9 with respect to housing 7 at the intermediate phase suitable for a cold start of the engine is the position shown in FIGS. 5A and 5B. However, in a case where, as shown in FIGS. 7A and 7B, the side edge of tip section 26*a* of first lock pin 26 is contacted on opposing inner side surface 24*b* at the advance angle side of first lock hole 24 and the side edge of tip section 27*a* of second lock pin 27 is contacted on opposing inner side surface 25*b* at the retardation angle side of second lock hole 25, namely, in a case where first lock pin 26 and second lock pin 27 are mutually separated from each other via predetermined gaps C3 and C4, a distance between first lock hole constituting member is (first lock hole 24) and third lock hole constituting member 1*c* (third lock hole 47) is needed to be shortened. Therefore, the thickness of partitioning wall section 48' (shown in FIG. 7B) cannot help being to be narrowed. Consequently, a strength (rigidity) is not only reduced but also there is a high possibility that, depending upon a situation, third lock hole 47 cannot be formed in terms of layout.

However, in this embodiment, according to a characteristic structure described above, the distance between first lock hole 24 and third lock hole 47 can sufficiently be elongated. Hence, the thickness of partitioning wall section 48 can be enlarged. Hence, a high rigidity (strength) can be obtained and a restriction on the layout can be avoided.

Furthermore, other system hydraulic pressures than the hydraulic pressures for respective hydraulic pressure chambers 11, 12 are used for the hydraulic pressures acted upon respective pressure receiving is chambers 32, 33. Hence, as compared with the usage of the hydraulic pressures of respective hydraulic pressure chambers 11, 12, a supply responsive characteristic of the hydraulic pressures to respective pressure receiving chambers 32, 33 becomes favorable and a response characteristic of backward movements (retreat movement or disengagement movement) of respective lock pins 26, 27 is improved.

In addition, a seal mechanism between respective hydraulic pressure chambers 11, 12 and respective pressure receiving chambers 32, 33 becomes unnecessary.

In addition, in this embodiment, both ends of each lock pin 26, 27 in the axial direction of each lock pin 26, 27 are communicated with corresponding one of advance angle hydraulic pressure chambers 12 via each oil hole 45*a*, 45*b*, 46*a*, 46*b* so that the mutually same hydraulic pressures are applied to the forward (retardation angle side) and rearward (advance angle side) sections of respective lock pins 26, 27 to achieve a balance of each lock pin 26, 27 in the axial direction thereof. Thus, it becomes possible to speedily move each lock pin 26, 27 axially in the forward and backward direction thereof according to a pressure difference between the spring force of each spring 29, 30 and the hydraulic pressure supplied to the corresponding one of each of first and second releasing purpose pressure receiving chambers 32, 33.

It should be noted that the upper end surface sides of respective pressure receiving sections 26*c*, 27*c* opposite to respective pressure receiving surfaces 26*e*, 27*e* of corresponding pressure receiving sections 26*c*, 27*c* are opened to the air through respectively corresponding breathing holes 43, 44 and breathing holes 43, 44 are formed within the inside of respective vanes 16*a*, 16*b* and within front cover 13 so that no communication with advance angle hydraulic pressure chambers 12 is carried out. Hence, no leakage of the working oil is present.

Since the hydraulic pressures within advance angle hydraulic pressure chambers 12 are supplied to both ends of the axial direction of lock pins 26, 27, a stabilization of a motion of each lock pin 26, 27 can be achieved.

That is to say, there is often the case that the working oil supplied to retardation angle hydraulic pressure chamber is mixed with air. If the air mixed working oil is supplied to both ends of lock pins 26, 27, the motion of lock pins 26, 27 due to air mixed with the working oil becomes unstable so that there is a possibility of a development of a tap tone and so forth on each of lock pin 26, 27.

However, almost no mixture of air with the hydraulic pressure supplied to advance angle hydraulic pressure chambers 12 during a steady-state driving after the engine start is present. Hence, motions of lock pins 26, 27 become stabilized so that the generation of tap tone can be suppressed.

In this embodiment, the elapsed time from the time at which the engine is stopped to the time at which the restart of the engine occurs is a parameter of the operation control described above. However, not the elapsed time, but the temperature information from engine temperature sensor ET may directly be parameterized in place of the elapsed time to control the operation and the operation may be controlled by dividing the engine temperature into a predetermined temperature or higher and lower than the predetermined temperature.

In addition, in this embodiment, the position holding section is divided into two couples of first lock pin 26 and first lock hole 24 and of second lock pin 27 and second lock hole 25. Thus, the thickness of sprocket 1 on which each lock hole 24, 25 is formed can be reduced. Hence, an axial length of the valve timing control apparatus can be shortened and a degree of freedom of the layout is improved.

Furthermore, in this embodiment, each lock pin 26, 27 is not formed in a cone shape but formed in the columnar shape. On the other hand, since each lock hole 24, 25 is accordingly formed in the circle (round shape), a, so-called, sticking phenomenon of each or either lock pin 26, 27 on the hole edge of the corresponding lock holes 24, 25 at the time of engagement and release of each lock hole 24, 25 is suppressed so that a smooth engagement-and-release action can be obtained.

The present invention is not limited to the structure of the embodiment described above. The valve timing control apparatus is applicable not only to the intake side but also to the exhaust side. Phase modification mechanism 3 is not limited to the use of vane member 9. The present invention is applicable to the phase conversion, for example, in which a helical gear is moved in the axial direction of the gear to convert the phase.

Furthermore, as the vehicle in which the engine is automatically stopped, the present invention is applicable to a, so-called, hybrid vehicle in which a drive source of the vehicle is switched between an electric motor and the internal combustion engine according to a traveling mode of the vehicle.

Technical ideas of the inventions graspable from the embodiment described above will be listed and explained below (1) The valve timing control apparatus of the internal combustion engine as claimed in claim 1, wherein each tip section of the first lock member and the second lock member on which each of the first lock member and the second lock member is engaged with a corresponding one of the first and second lock recess sections is formed in a columnar shape.

Since each tip section is formed in the columnar shape, a retreating movement (axial backward movement) from the corresponding one of each recess section can be smoothed.

(2) The valve timing control apparatus of the internal combustion engine as claimed in claim 1, wherein each of the first and second lock members is arbitrarily axially movable.

(3) The valve timing control apparatus of the internal combustion engine as set forth in item (2), wherein the mutually same pressures are acted upon both ends of each of the first and second lock members in an axial direction of each of the first and second lock members and a hydraulic pressure is acted upon a flange shaped pressure receiving section installed on an outer surface of each of the first and second lock members to move a corresponding one of the first and second lock members in the axial direction of the corresponding one of the first and second lock members.

According to the invention described in item (3), the mutually same pressures are acted upon both ends of each lock member. Hence, a speedy movement of each lock member in the axial direction of each lock member according to the hydraulic pressure acted upon each pressure receiving section (of the corresponding one of each lock member) can be achieved.

(4) The valve timing control apparatus of the internal combustion engine as set forth in item (3), wherein each of the first and second lock members is biased toward a direction of the corresponding one of the first and second lock recess sections by means of a corresponding one of first and second biasing members and an opposite side to a pressure receiving side of each pressure receiving section is opened to the air.

(5) The valve timing control apparatus of the internal combustion engine as set forth in item (4), wherein a supply-and-exhaust of the hydraulic pressure to each of the pressure receiving sections is carried out by means of a hydraulic pressure control valve installed on an exclusive-use hydraulic pressure circuit.

Since, according to the invention described in item (5), each lock member is moved in the backward direction (retreating (backward movement against the biasing force of the corresponding spring) using the hydraulic pressure control valve installed in the exclusive-use hydraulic pressure circuit other than the hydraulic pressure circuit used for the phase modification mechanism, (6) The valve timing control apparatus of the internal combustion engine as claimed in claim 1, wherein the first lock member and the second lock member are installed on the vane member.

(7) The valve timing control apparatus of the internal combustion engine as set forth in item (6), wherein the advance and retardation angle members are installed in plural and the vane member includes a plurality of vanes and the first lock member and the second lock member are disposed on mutually different vanes of the vanes.

(8) The valve timing control apparatus of the internal combustion engine as claimed in claim 1, wherein the engine is automatically stopped independently of an operation of an ignition switch and, in a case where the engine is stopped according to an operation of the ignition switch, the first lock member is controlled to be engaged with the third lock recess section and, at the same time, the second lock member is controlled to be maintained at an axially backward moved state from the second recess section.

It should be noted that the axially backward moved state has the same meaning of the disengagement state.

(9) The valve timing control apparatus of the internal combustion engine as set forth in item (8), wherein the engine is stopped after a confirmation by an electronic controller that the first lock member is engageably inserted into the first lock recess section or the third lock recess section.

It should be noted that the advance angle side includes the meaning of the advance angle direction and the retardation angle side includes the meaning of the retardation angle direction and an engine valve corresponds to the intake valve or the exhaust valve.

This application is based on a prior Japanese Patent Application No. 2011-134739 filed in Japan on Jun. 17, 2011. The entire contents of this Japanese Patent Application No. 2011-134739 are hereby incorporated by reference. Although the invention has been described above by reference to certain embodiments of the invention, the invention is not limited to the embodiment described above. Modifications and variations of the embodiments described above will occur to those skilled in the art in light of the above teachings. The scope of the invention is defined with reference to the following claims.

What is claimed is:

1. A valve timing control apparatus of an internal combustion engine, comprising:

a housing to which a turning force is transmitted from a crankshaft of the engine and on an inside of which a working oil chamber is provided;

a vane member fixed on a camshaft, the camshaft making at least one engine valve of the engine open or close, that partitions the working oil chamber into at least one advance angle hydraulic pressure chamber and at least one retardation angle hydraulic pressure chamber, and that relatively revolves toward an advance angle side to the housing and toward a retardation angle side to the housing by selectively supplying and exhausting a working oil to and from the advance angle hydraulic pressure chamber and the retardation angle hydraulic pressure chamber;

a first lock member installed axially movably on either one of the housing and the vane member;

a first lock recess section installed on the other of the housing and the vane member and with which the first lock member is engaged when the vane member is relatively revolved at an intermediate phase position between a most advance angle side and a most retardation angle side;

a second lock member installed axially movably on either one of the housing and the vane member;

a second recess section installed axially movably on the other of the housing and the vane member and with which the second lock recess section is engaged when the vane member is relatively revolved at the intermediate phase position; and a third lock recess section installed at the retardation angle side in a circumferential direction of the housing with respect to the first lock recess section to limit a relative rotary position of the vane member at the most retardation angle side by an engagement of the first lock member with the third lock recess section, the first lock recess section, in a state in which the first lock member is engaged with the first lock recess section, allowing a movement of the first lock member by a predetermined quantity toward the advance angle side and limiting the movement of the first lock member toward the retardation angle side of the first lock member and the second lock recess section, in a state in which the second lock member is engaged with the second lock recess section, allowing a movement of the second lock member by another predetermined quantity toward the retardation angle side and limiting the movement of the second lock member toward the advance angle side of the second lock member.

2. The valve timing control apparatus of the internal combustion engine as claimed in claim 1, wherein each tip section of the first lock member and the second lock member on which each of the first lock member and the second lock member is engaged with a corresponding one of the first and second lock recess sections is formed in a columnar shape.

3. The valve timing control apparatus of the internal combustion engine as claimed in claim 1, wherein each of the first and second lock members is arbitrarily axially movable.

4. The valve timing control apparatus of the internal combustion engine as claimed in claim 3, wherein the mutually same pressures are acted upon both ends of each of the first and second lock members in an axial direction of each of the first and second lock members and a hydraulic pressure is acted upon a flange shaped pressure receiving section installed on a corresponding outer surface of each of the first and second lock members to move a corresponding one of the first and second lock members in the axial direction of the corresponding one of the first and second lock members.

5. The valve timing control apparatus of the internal combustion engine as claimed in claim 4, wherein each of the first and second lock members is biased toward a direction of the corresponding one of the first and second lock recess sections by means of a corresponding one of first and second biasing members and an opposite side to a pressure receiving side of each pressure receiving section is opened to the air.

6. The valve timing control apparatus of the internal combustion engine as claimed in claim 5, wherein supply and exhaust of the hydraulic pressure to each of the pressure receiving sections is carried out by means of a hydraulic pressure control valve installed on an exclusive-use hydraulic pressure circuit.

7. The valve timing control apparatus of the internal combustion engine as claimed in claim 4, wherein the first lock member and the second lock member are installed on the vane member.

8. The valve timing control apparatus of the internal combustion engine as claimed in claim 7, wherein the advance and retardation angle members are installed in plural and the vane member includes a plurality of vanes and the first lock member and the second lock member are disposed on mutually different vanes of the vanes.

9. The valve timing control apparatus of the internal combustion engine as claimed in claim 1, wherein the engine is automatically stopped independently of an operation of an ignition switch and, in a case where the engine is stopped according to an operation of the ignition switch, the first lock member is controlled to be engaged with the third lock recess section and, at the same time, the second lock member is controlled to be maintained at an axially backward moved state from the second recess section.

10. The valve timing control apparatus of the internal combustion engine as claimed in claim 9, wherein the engine is stopped after a confirmation by an electronic controller that the first lock member is engageably inserted into the first lock recess section or the third lock recess section.

11. A valve timing control apparatus of an internal combustion engine, comprising:

a housing to which a turning force from a crankshaft is transmitted and on an inside of which a working oil chamber is provided;

a vane member fixed on a camshaft, the camshaft making at least one intake valve of the engine open or close, that partitions the working oil chamber into at least one advance angle hydraulic pressure chamber and at least one retardation angle hydraulic pressure chamber, and that relatively revolves toward an advance angle side to the housing and toward a retardation angle side to the housing by selectively supplying and exhausting the working oil to and from the advance angle hydraulic pressure chamber and the retardation angle hydraulic pressure chamber;

a first lock member installed axially movably on the vane member;

a first lock recess section installed on the housing and with which the first lock member is engaged when the vane member is relatively revolved at an intermediate position member is relatively revolved at an intermediate position between a most advance angle side and a most retardation angle side; and a third lock recess section installed at a retardation angle side of the housing in a circumferential direction of the housing with respect to the first lock recess section of the housing to limit a relative revolution position of the vane member at the most retardation angle side by an engagement of the third lock recess section with the first lock member, wherein the first lock recess section is so constructed that, in a state in which the first lock member is engaged with the first lock recess section, an inner surface of the first lock recess section at an advance angle side of the first lock recess section is in a non-contact state against an outer surface of the first lock member opposing against the inner surface of the first lock recess section and another outer surface of the first lock recess section at a retardation angle side of the first lock recess section and another outer surface of the first lock member opposing against the other inner surface of the first lock recess section are contacted on each other to limit a further movement of the first lock member toward the retardation angle side.

12. A valve timing control apparatus of an internal combustion engine, comprising:

a drive rotary body to which a turning force is transmitted from a crankshaft;

a driven rotary body fixed on a camshaft, the camshaft making at least one intake valve open or close and that revolves a relative revolution angle to the drive rotary body in accordance with an operating state of the engine within a predetermined angle range;

a phase modification mechanism equipped with at least one advance angle hydraulic pressure chamber and at least one retardation angle hydraulic pressure chamber and that relatively revolves the driven rotary body toward an advance angle side to the driven rotary body and a retardation angle side to the drive rotary body by selectively supplying and exhausting working oil to and from both of the advance and retardation angle hydraulic chambers;

a first lock member installed axially movably on either one of the drive rotary body and the driven rotary body;

a first lock recess section installed on the other of the drive rotary body and the driven rotary body to hold the driven rotary body at an intermediate phase position between a most advance angle side and a most retardation angle side by an engagement of the first lock member with the first lock recess section;

a second lock member installed axially movably on either one of the drive rotary body and the driven rotary body;

a second lock recess section installed on the other of the drive rotary body and the driven rotary body to hold the driven rotary body at the intermediate phase position when the second lock member is engaged with the second lock recess section; and a third lock recess section installed at a retardation angle side in a circumferential direction from the first lock recess section to limit a relative rotary position of the driven rotary body at a most retardation angle side by an engagement of the first lock member with the third lock recess section, the first lock recess section, in a state in which the first lock member is engaged with the first lock recess section, allowing a movement of the first lock member by a predetermined quantity toward the advance angle side and limiting the movement of the first lock member toward the retardation angle side and the second lock recess section, in a state in which the second lock member is engaged with the second lock recess section, allowing a movement of the second lock member by another predetermined quantity toward the retardation angle side and limiting the movement of the second lock member toward the advance angle side.

* * * * *